US007286002B1

(12) United States Patent
Jackson

(10) Patent No.: US 7,286,002 B1
(45) Date of Patent: Oct. 23, 2007

(54) CIRCUIT AND METHOD FOR STARTUP OF A BAND-GAP REFERENCE CIRCUIT

(75) Inventor: Scott A. Jackson, Apex, NC (US)

(73) Assignee: Cypress Semiconductor Corporation, San Jose, CA (US)

( * ) Notice: Subject to any disclaimer, the term of this patent is extended or adjusted under 35 U.S.C. 154(b) by 0 days.

(21) Appl. No.: 11/003,892

(22) Filed: Dec. 3, 2004

Related U.S. Application Data

(60) Provisional application No. 60/527,203, filed on Dec. 5, 2003.

(51) Int. Cl.
*G05F 3/04* (2006.01)
*G05F 3/08* (2006.01)
*G05F 3/16* (2006.01)

(52) U.S. Cl. ..... 327/539; 327/540; 327/552

(58) Field of Classification Search ..... 327/539, 327/540, 552, 543, 554; 323/314
See application file for complete search history.

(56) References Cited

U.S. PATENT DOCUMENTS 3,887,863 A * 6/1975 Brokaw ..... 323/314
4,723,108 A 2/1988 Murphy et al.
4,792,748 A * 12/1988 Thomas et al. ..... 323/312
5,285,369 A * 2/1994 Balakrishnan ..... 363/49
5,619,166 A 4/1997 Gross
5,710,778 A 1/1998 Bettman et al.
5,867,013 A 2/1999 Yu
5,907,255 A 5/1999 Churchill
5,946,255 A 8/1999 Saripella et al.
6,016,277 A 1/2000 Ansel et al.
6,137,720 A 10/2000 Lancaster
6,181,121 B1 1/2001 Kirkland et al.
6,194,885 B1 * 2/2001 Oshima ..... 323/285
6,265,931 B1 7/2001 Lutley et al.
6,278,320 B1 * 8/2001 Vu ..... 327/539
6,608,472 B1 8/2003 Kutz et al.
6,836,415 B1 * 12/2004 Yang et al. ..... 363/21.01

* cited by examiner

*Primary Examiner*—Bao Q. Vu
(74) *Attorney, Agent, or Firm*—Brownstein Hyatt Farber Schreck, P.C.

(57) ABSTRACT

A circuit and method for starting up a band-gap reference circuit. In one example, a startup circuit compares a Vbg voltage output of a band-gap reference circuit to a voltage (such as Vbe) across a transistor in order to selectively control whether to inject current into the band-gap reference circuit during startup.

15 Claims, 4 Drawing Sheets

CIRCUIT AND METHOD FOR STARTUP OF A BAND-GAP REFERENCE CIRCUIT

CROSS REFERENCE TO RELATED APPLICATION

This application claims priority under 35 U.S.C. 119(e) to U.S. Provisional Patent Application No. 60/527,203 entitled "A Failsafe Band-gap Reference Startup Circuit" filed Dec. 5, 2003, the disclosure of which is hereby incorporated by reference in its entirety.

FIELD OF THE INVENTION

This invention, in general, relates to electronic circuits and in particular to band-gap reference circuits and related startup circuits.

BACKGROUND OF THE INVENTION

A band-gap reference is a circuit that creates a voltage reference that is constant across process variation, supply voltage, and temperature. These circuits are used to generate output voltages of regulators, reference voltages for input/output circuits, precise biasing signals, and any other application requiring a constant voltage reference. Some band-gap references generate a current reference as well to be used in biasing circuits to provide desired operating points.

Referring to FIG. 2, a conventional band-gap reference circuit is shown providing a Vbg output reference signal. Band-gap reference circuits typically comprise current sources or comparators that force the output of a band-gap reference circuit higher than some low convergence point. The band-gap reference circuit has multiple convergence points, meaning that the band-gap reference circuit might have multiple output voltages that it can become trapped at. For example, a typical band-gap voltage reference produces a 1.2V output. Other circuits are then designed to use this 1.2V output. However, during power up of a bang-gap circuit, the output might also have a lower convergence point such as a 0.4V output voltage and become trapped at this value. This may be due, for example, to certain offset conditions in the feedback loop of the error amplifier of the band-gap reference circuit.

A startup circuit is used to guarantee the band-gap reference circuit does not get trapped at a lower convergence point, and the start up circuit pulls the band-gap reference circuit output up to the correct level (e.g., 1.2V). Two examples of conventional band-gap startup circuits are shown in FIGS. 1A-B and provide a startup current for use in a band-gap reference circuit.

Both startup circuits in FIGS. 1A-B operate under the principle that the startup current 'Istartup' is connected to some node in the band-gap reference circuit having multiple convergence points. If the node in the band-gap reference circuit is low (which will be the case during start-up), current is sourced into the node until it reaches a desired level and turns off the sourcing device (i.e., NMOS transistors Q4, Q6 in FIGS. 1A-B).

As recognized by the present inventor, disadvantages of conventional band-gap startup circuits include that their output current (used to startup the band-gap reference circuit) can vary with process, voltage and temperature (PVT). As a result of these variations, conventional band-gap startup circuits do not always guarantee startup for a band-gap reference circuit. For example, the current 'Istartup' in FIGS. 1A-B can shut-off before the band-gap reference circuit to which it is connected reaches its desired operating point. Furthermore, as recognized by the present inventor, if the startup current does not turn off after the ban-gap circuit is at its desired operating point, the extra current from the startup circuit can cause the band-gap reference circuit to provide an incorrect output Vbg.

As recognized by the present inventor, what is needed is a circuit and method for startup of a band-gap reference circuit that provides startup signals substantially independent of PVT variations or fluctuations.

It is against this background that various embodiments of the present invention were developed.

SUMMARY

In light of the above and according to one broad aspect of one embodiment of the present invention, disclosed herein is a startup circuit that forces a band-gap reference circuit to start-up and converge to a desired operating point.

According to another broad aspect of another embodiment of the present invention, disclosed herein is a method of starting up a band-gap reference circuit having a band-gap voltage output. In one example, the method includes providing a startup reference signal; comparing the band-gap voltage output to the startup reference signal; and based on the comparing operation, selectively activating a startup current for starting up the band-gap reference circuit.

In one example, the operation of providing a startup reference signal includes providing a voltage across a transistor to establish the startup reference signal. The transistor may be a bipolar junction transistor or other transistor type, and in one example, the voltage across the transistor is between a base and an emitter of the transistor. In another embodiment, the operation of providing a startup reference signal includes providing a voltage across a diode to establish the startup reference signal.

In one example, the comparing operation utilizes a comparator with hysteresis. The operation of selectively activating the startup current may include enabling the startup current if the band-gap voltage output is less than the startup reference signal. This enabling operation pulls the band-gap voltage output towards a desired convergence point. The enabling operation, in one example, sinks the startup current. The startup current is disabled if the band-gap voltage output is greater than the startup reference signal.

According to another broad aspect of another embodiment of the present invention, disclosed herein is a band-gap reference circuit including a circuit portion for generating a band-gap voltage reference output; a circuit portion providing a startup reference voltage; and a circuit portion for comparing the band-gap voltage output to the startup reference signal to selectively activate a startup current for starting up the band-gap reference circuit.

In one example, the circuit portion providing a startup reference voltage may include a current source having an output; and a PNP transistor having a base, an emitter and a collector, the emitter receiving the output of the current source to establish a base-to-emitter voltage as the startup reference voltage. In another example, the circuit portion providing a startup reference voltage may include a diode voltage to establish the startup reference signal.

The circuit portion for comparing may include a comparator with or without hysteresis. In one example, the startup current is selectively activated if the band-gap voltage output is less than the startup reference signal, and selectively deactivated if the band-gap voltage output is greater than the startup reference signal.

According to another broad aspect of another embodiment of the present invention, disclosed herein is a band-gap reference circuit including means for generating a band-gap reference voltage; means for generating a startup reference signal; means for comparing the band-gap reference voltage to the startup reference signal; and means for selectively starting the band-gap reference circuit based on the comparing means. In one example, the means for selectively starting the band-gap reference circuit increases the band-gap reference voltage if the band-gap reference voltage is less than the startup reference signal.

The features, utilities and advantages of the various embodiments of the invention will be apparent from the following more particular description of embodiments of the invention as illustrated in the accompanying drawings.

DETAILED DESCRIPTION

Embodiments of the present invention provide various circuits and methods for starting up a band-gap reference circuit. As will be described below, a startup reference signal is provided which may be derived, for example, from a diode voltage or a voltage across a transistor (such as a base-to-emitter voltage). The band-gap voltage output of the band-gap reference circuit is compared with the startup reference signal, and based on this comparison, a startup current is selectively activated and applied for starting up the band-gap reference circuit. Various embodiments of the present invention will now be described.

Figure 1A:
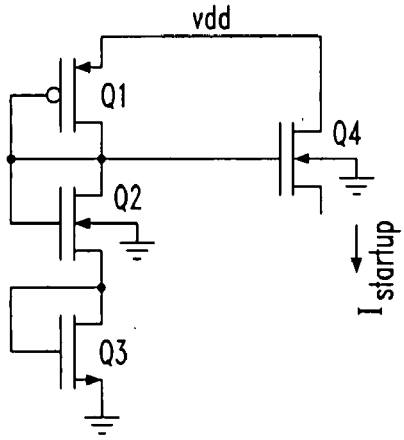
FIGS. 1A-B illustrate conventional startup circuits for use with a band-gap reference circuit.
Figure 1B:
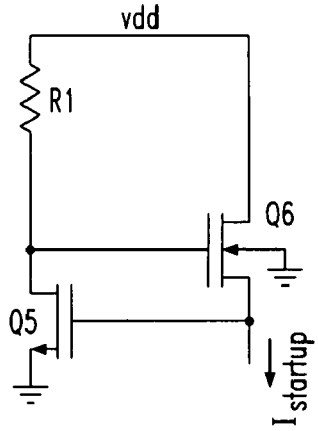
Figure 2:
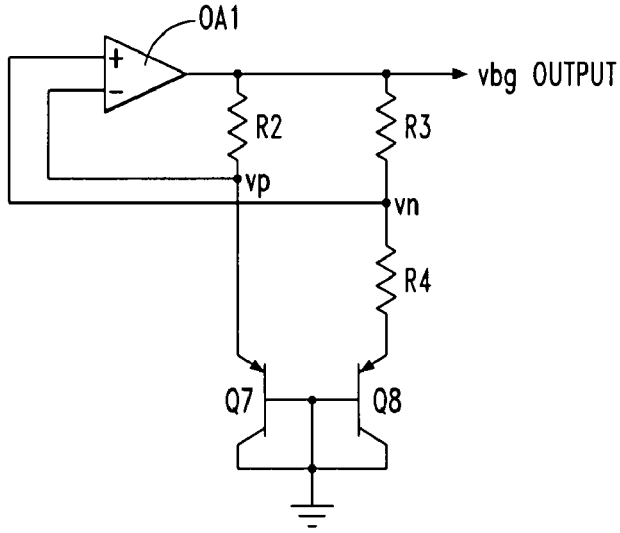
FIG. 2 illustrates an example of a band-gap reference circuit.

For clearer understanding of an improved startup circuit in accordance with one embodiment of the present invention, the mechanisms involved in startup of a band-gap reference are discussed. FIG. 2 shows a band-gap voltage reference circuit. The conventional band-gap voltage reference produces a stable reference on the Vbg node which is the output of the band-gap reference circuit. At convergence, the Vp node voltage will equal the Vn node voltage, apart from any offset and gain error. A graph of the difference in Vp and Vn (Vp−Vn) versus Vbg is shown in FIG. 3.

Figure 3:
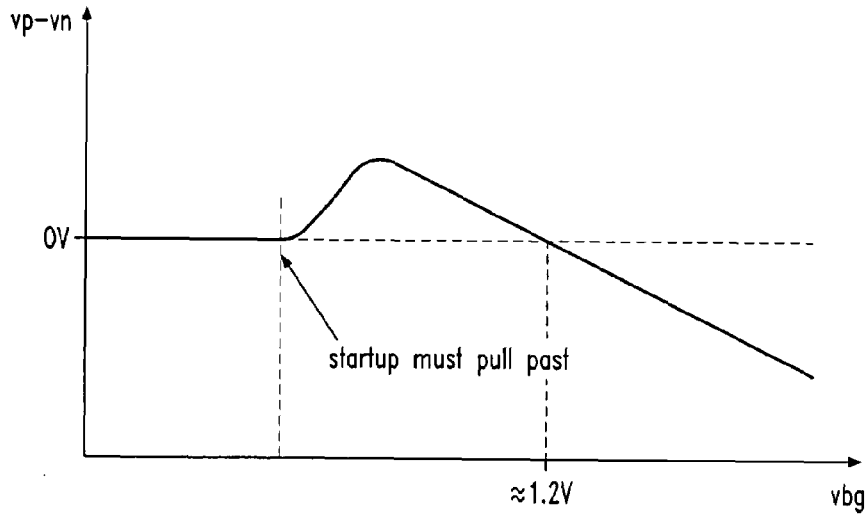
FIG. 3 is a graph of Vp−Vn vs. Vbg for a typical band-gap reference circuit.
Figure 4:
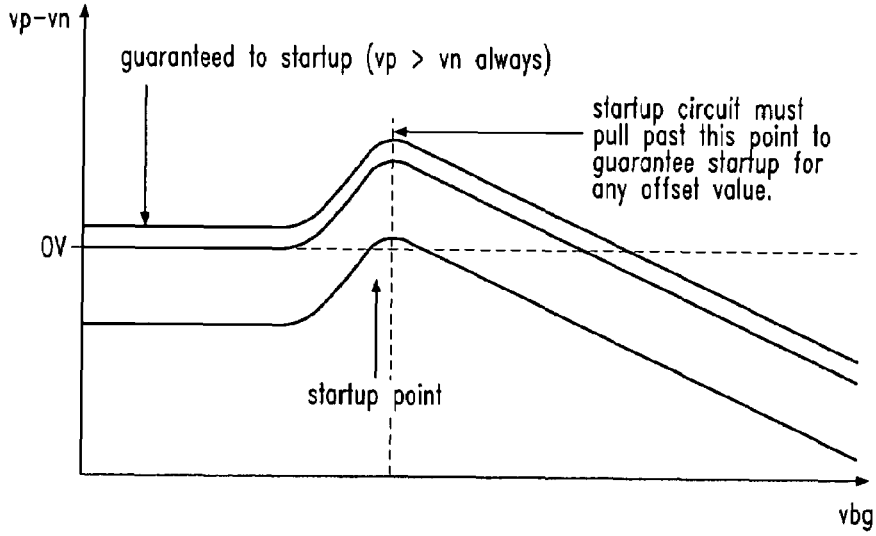
FIG. 4 is a graph of Vp−Vn vs. Vbg for different offset conditions for a typical band-gap reference circuit.

In FIG. 3, the preferred convergence point is where the Vp−Vn graph crosses the 0V line during its downward slope to produce the desired band-gap reference voltage (i.e., 1.2v). However, there are many other places for low Vbg where the Vp−Vn graph lies on the 0V line. Without a startup circuit to force Vbg beyond the point where Vp−Vn rises above 0V, the circuit can converge at any point where Vp−Vn equals 0V. Once Vbg is pulled past this point (i.e. Vp−Vn>0), the feedback action of the band-gap reference circuit will force the band-gap reference circuit to move to the desired Vbg output level. FIG. 3 shows the ideal situation with no offset voltage. In real-life applications, circuits almost always have offset voltage. FIG. 4 shows a similar graph with two different offset voltage conditions (one positive and one negative) shown.

The upper and lower curves in FIG. 4 illustrate two different offset conditions. It can be seen from the graph of FIG. 4 that the offset will take the ideal curve of FIG. 3 and shift it either up or down while maintaining the same shape as shown in FIG. 4. The offset direction cannot be predicted due to the generally random nature of offset conditions, and therefore as recognized by the present inventor, a startup circuit should be designed to start a band-gap reference circuit in all cases of offset. For the curve that has shifted upward in FIG. 4, the band-gap reference circuit is guaranteed to startup and converge correctly under all conditions. For the curve that has shifted downward in FIG. 4, two convergence points exist. For any value of Vp−Vn less than the first 0V crossing, the output will be forced back to 0V due to the feedback and the bang-gap circuit will not startup. The worst case offset condition that can occur and the band-gap reference circuit still function is for the offset to equal the peak of the Vp−Vn curve—as recognized by the present inventor, if the startup circuit pulls the band-gap reference circuit past this peak point under all conditions, the band-gap reference is guaranteed to startup.

This peak point of the Vp−Vn curve corresponds approximately to the knee point of the bipolar junction transistor (BJT) or diode current/voltage (I/V) curve, as recognized by the present inventor. Hence, a bipolor junction transistor or diode may be used in the startup circuit that has the same knee point of its current/voltage (I/V) curve as the knee/peak point of the Vp−Vn curve of FIGS. 3-4. This knee point of the transistor or diode can be measured as the voltage between the transistor's base to emitter (Vbe). Hence, some embodiments of the present invention compare Vbg of a band-gap reference circuit to a startup reference signal, such as the voltage Vbe across the base-emitter junction of a transistor or a voltage across a diode or the like. For simplicity of this disclosure, the startup reference signal will be described herein using the example of Vbe across a transistor, but it is understood that the startup reference signal could be generated by other voltages of devices.

Figure 5:
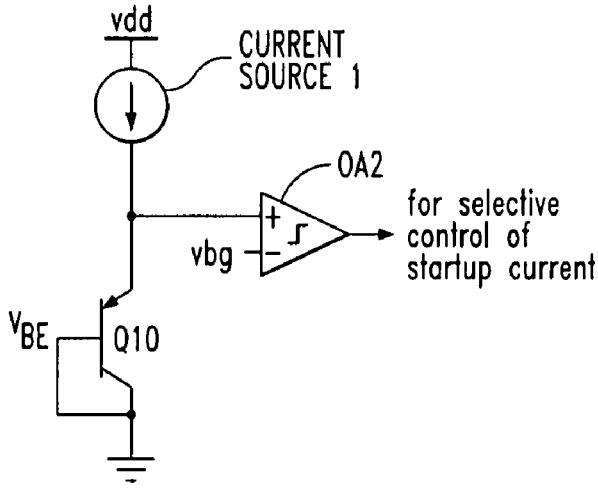
FIG. 5 illustrates an example of a startup circuit for a band-gap reference circuit, in accordance with one embodiment of the present invention.

In FIG. 5, one example of a startup circuit is illustrated in accordance with an embodiment of the present invention. This circuit includes a transistor Q10 (i.e., a PNP BJT), a current source coupled with the emitter of the transistor, and a comparator OA2 which compare the transistor voltage Vbe to the band-gap voltage of the band-gap reference circuit. The comparator may be implemented by any conventional comparator or differential amplifier with or without hysteresis. The output of the comparator is used to selectively control/activate a startup current for starting up the band-gap reference circuit.

In FIG. 5, when Vbg of a band-gap reference circuit exceeds the startup reference signal of the base-emitter voltage (Vbe) of the transistor Q10, the band-gap reference circuit has pulled past the peak point (i.e., pas the knee of its curve in FIG. 4) and the feedback amplifier of the band-gap reference circuit will force convergence to the desired band-gap reference output value.

Figure 6:
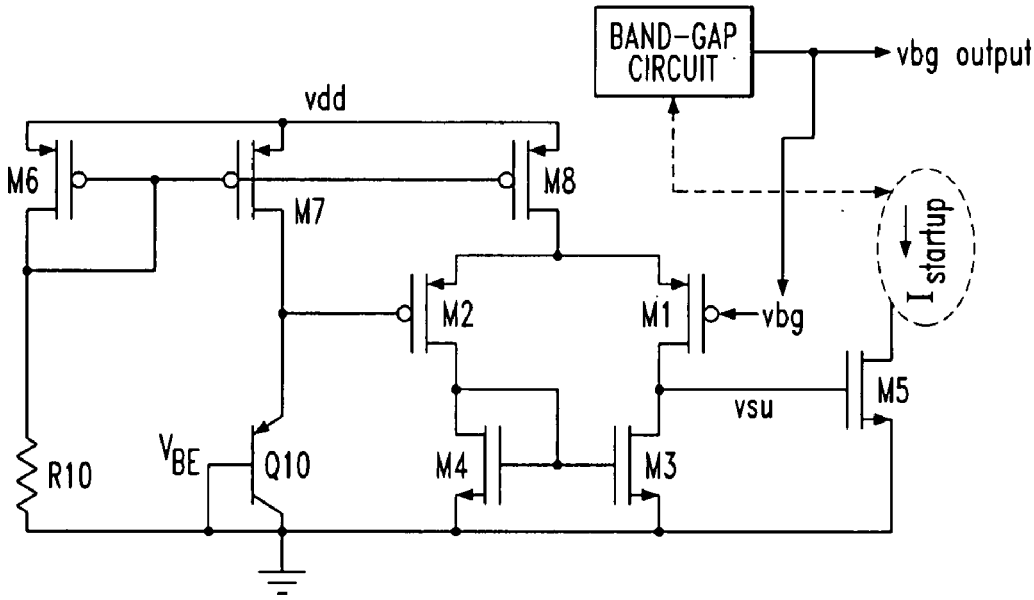
FIG. 6 illustrates another example of a startup circuit for a band-gap reference circuit, in accordance with one embodiment of the present invention.

FIG. 6 shows another example of a startup circuit in accordance with an embodiment of the present invention. In FIG. 6, a comparator compares the Vbe of Q10 with the Vbg output of the band-gap reference circuit, and the comparator selectively activates a startup current through transistor M5 that can be used to pull the Vbg node up of the band-gap reference circuit. Resistor R10 and transistor M6 form a bias current source that is mirrored through transistor M7 into transistor Q10. A differential amplifier is comprised of transistors M1-M4. The current flow through transistor Q10 will force a Vbe voltage to develop across transistor Q10. The differential amplifier compares the band-gap reference voltage Vbg with the Vbe of Q10. If Vbg is less than the Vbe of Q10, the node vsu will be a positive voltage causing current flow 'Istartup' through transistor M5. This 'Istartup' current can then be used as a startup current for a band-gap reference circuit (i.e., to increase the current into the Vbg node of FIG. 2 pulling this node to a higher value). If Vbg is greater than the Vbe of Q10, the vsu node voltage will be zero turning off transistor M5 which forces the current 'Istartup' to be zero. This will occur at approximately the time when the band-gap reference circuit has successfully started up.

Figure 7:
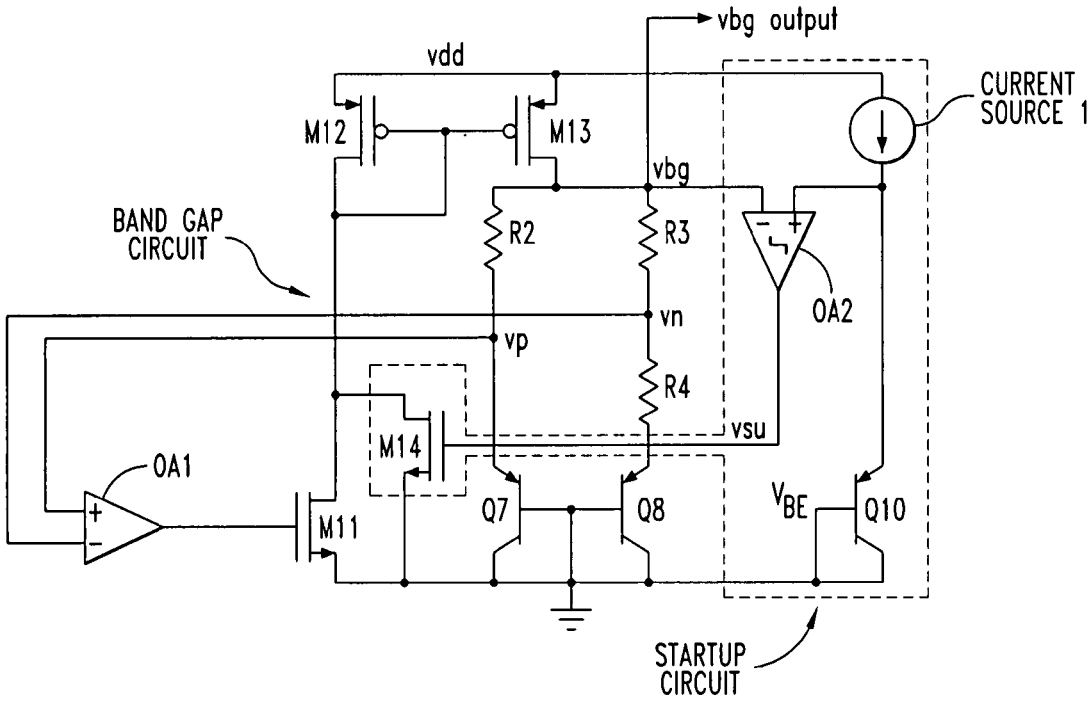
FIG. 7 illustrates an example of a band-gap reference circuit with an example of a startup circuit connected thereto, in accordance with one embodiment of the present invention.

FIG. 7 shows another embodiment of the present invention, wherein a startup circuit is coupled with a band-gap reference circuit providing an output reference voltage Vbg. As with FIG. 5, the comparator OA2 may be implemented using any conventional comparator or differential amplifier with or without hysteresis. During a startup condition, the Vbg node voltage of FIG. 7 may converge to a value less than the desired output (i.e., less than 1.2V). The comparator OA2 will compare the Vbg node voltage with the Vbe of the bipolar junction transistor Q10. If the Vbg node voltage is less than Vbe, the vsu node voltage will become a positive value turning on transistor M14. This will force an increase in current through transistors M12 and M13, which will force the Vbg node to a higher voltage. When the Vbg node voltage exceeds the Vbe voltage, the comparator OA2 will force the vsu node voltage to zero, turning off transistor M14. The band-gap voltage circuit will then converge to the correct Vbg node output voltage (such as 1.2v) due to the feedback loop formed by amplifier OA1.

Stated differently, during startup as the supply voltage Vdd ramps from 0V to its final value, current will flow in the PNP transistor Q10 forming a Vbe reference which is applied to the positive input of a comparator OA2. While Vbg (connected to the negative input of the comparator) is less than this Vbe, the comparator OA2 will sink additional current from the PMOS current mirror M12, M13 pulling up the Vbg node. Of course, while FIG. 7 and FIG. 6 show the startup circuit sinking current, alternatively the startup circuit could startup the band-gap reference circuit using a current source depending upon the implementation.

When Vbg rises above the Vbe reference, the comparator OA2 will turn off. At this point, Vp is greater than Vn for all offset conditions and the feedback action of the band-gap portion of the circuit of FIG. 7 will force the output reference signal Vbg to its final value and desired convergence point. The circuit of FIG. 7 has the advantage of guaranteeing startup, it is believed under almost all PVT conditions, so long as the supply voltage Vdd is higher than the desired output voltage Vbg.

In alternate embodiments, the comparators shown in FIGS. 5-7 may be interchanged with any type of comparator, and all field effect transistors (FETs) are interchangeable with other types of transistors. In other embodiments, any resistors used for biasing can be interchanged with active devices, and any bipolar transistors (such as Q10) can be interchanged with a diode or other device having similar relevant I/V characteristic.

As used herein, the term "transistor" or "switch" includes, but is not limited to, any switching element which can include, for example, n-channel or p-channel CMOS transistors, MOS-FETs, FETs, BJTs or other like switching element or device. The particular type of switching element used is a matter of choice depending on the particular application of the circuit, and may be based on factors such as power consumption limits, response time, noise immunity, fabrication considerations, etc. Hence while embodiments of the present invention are described in terms of p-channel and n-channel transistors and BJTs, it is understood that other switching devices can be used, or that the invention may be implemented using the complementary transistor types.

Embodiments of the present invention may be used in various semiconductors, memories, processors, controllers, integrated circuits, logic or programmable logic, communications devices, other circuits, and the like.

While the methods disclosed herein have been described and shown with reference to particular operations performed in a particular order, it will be understood that these operations may be combined, sub-divided, or re-ordered to form equivalent methods without departing from the teachings of the present invention. Accordingly, unless specifically indicated herein, the order and grouping of the operations is not a limitation of the present invention.

It should be appreciated that reference throughout this specification to "one embodiment" or "an embodiment" or "one example" or "an example" means that a particular feature, structure or characteristic described in connection with the embodiment may be included, if desired, in at least one embodiment of the present invention. Therefore, it should be appreciated that two or more references to "an embodiment" or "one embodiment" or "an alternative embodiment" or "one example" or "an example" in various portions of this specification are not necessarily all referring to the same embodiment. Furthermore, the particular features, structures or characteristics may be combined as desired in one or more embodiments of the invention.

Similarly, it should be appreciated that in the foregoing description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed inventions require more features than are expressly recited in each claim. Rather, as the following claims reflect, inventive aspects lie in less than all features of a single foregoing disclosed embodiment, and each embodiment described herein may contain more than one inventive feature.

While the invention has been particularly shown and described with reference to embodiments thereof, it will be understood by those skilled in the art that various other changes in the form and details may be made without departing from the spirit and scope of the invention.

What is claimed is:

1. A method of starting up a band-gap reference circuit having a first comparator and a band-gap voltage output, comprising:

providing a startup reference signal by injecting a current from a current source into a p-type transistor, the p-type transistor providing the start-up reference signal;

comparing with a second comparator the band-gap voltage output to the startup reference signal; and based on the comparing operation, selectively activating a startup current for starting up the band-gap reference circuit, the startup current raising the band-gap voltage output of the band-gap reference circuit.

2. The method of claim 1, wherein the voltage across the transistor is between a base and an emitter of the transistor.

3. The method of claim 1, wherein the comparing operation utilizes a comparator with hysteresis.

4. The method of claim 1, wherein the operation of selectively activating the startup current further comprises:

enabling the startup current if the band-gap voltage output is less than the startup reference signal.

5. The method of claim 4, wherein the enabling operation pulls the band-gap voltage output towards a desired convergence point.

6. The method of claim 4, wherein the enabling operation sinks the startup current.

7. The method of claim 1, wherein the operation of selectively activating a startup current further comprises:

disabling the startup current if the band-gap voltage output is greater than the startup reference signal.

8. A band-gap reference circuit, comprising:

a circuit portion for generating a band-gap voltage output of the band-gap reference circuit, the circuit portion including a first comparator;

a circuit portion providing a startup reference voltage, wherein the circuit portion providing a startup reference voltage further comprises a current source having an output, and a PNP transistor having a base, an emitter and a collector, the emitter receiving the output of the current source to establish a base-to-emitter voltage as the startup reference voltage; and a circuit portion having a second comparator for comparing the band-gap voltage output to the startup reference signal to selectively activate a startup current for starting up the band-gap reference circuit, the start-up current increasing the band-gap voltage output of the band-gap reference circuit.

9. The circuit of claim 8, wherein the second comparator has hysteresis.

10. The circuit of claim 8, wherein the circuit portion for comparing the band-gap voltage output to the startup reference signal selectively activates the startup current if the band-gap voltage output is less than the startup reference signal.

11. The circuit of claim 8, wherein the circuit portion for comparing the band-gap voltage output to the startup reference signal selectively deactivates the startup current if the band-gap voltage output is greater than the startup reference signal.

12. The circuit of claim 8, wherein the startup current is a sunk current.

13. The circuit of claim 8, wherein the startup current is a sourced current.

14. A band-gap reference circuit, comprising:

means for generating a band-gap reference voltage, wherein said means for generating includes a first comparator;

means for generating a startup reference signal, wherein said means for generating includes a p-type transistor and a current source providing a current into the p-type transistor thereby generating the start-up reference signal on the p-type transistor;

means for comparing the band-gap reference voltage to the startup reference signal, said means for comparing including a second comparator; and means for selectively starting the band-gap reference circuit based on the comparing means.

15. The circuit of claim 14, wherein the means for selectively starting the band-gap reference circuit increases the band-gap reference voltage if the band-gap reference voltage is less than the startup reference signal.

* * * * *